United States Patent [19]

Conlon

[11] 3,969,080

[45] July 13, 1976

[54] STABILIZING MEANS FOR LABORATORY WARE

[76] Inventor: Daniel R. Conlon, 600 Meeting House Road, Jenkintown, Pa. 19046

[22] Filed: Aug. 20, 1974

[21] Appl. No.: 498,946

[52] U.S. Cl. ..... 23/259; 23/292; 248/364

[51] Int. Cl.[2] ..... B01L 3/00; B01L 9/00

[58] Field of Search ..... 23/259, 292; 161/218; 273/72 R, 26 B; 428/379; 248/364, 500, 504

[56] References Cited

UNITED STATES PATENTS

| | | | |
|---|---|---|---|
| 1,895,156 | 1/1933 | Fisher | 23/292 X |
| 2,608,409 | 8/1952 | Pinkerton | 273/72 R |
| 2,916,184 | 12/1959 | Hartley et al. | 248/1 |
| 3,521,883 | 7/1970 | Hamilton | 273/72 R X |
| 3,716,239 | 2/1973 | Goudreau | 273/26 B |

OTHER PUBLICATIONS

VWR Scientific, Catalogue 1972, pp. 399 and 402.
Sargent Welch Catalogue No. 119, 1971, p. 336.
"The Sporting Goods Dealer," p. 174, Dec. 1969.
Fisher Scientific Co., Catalog 63, Modern Laboratory Appliances, pp. 830 and 911, (1962).

*Primary Examiner*—Morris O. Wolk
*Assistant Examiner*—Barry I. Hollander

[57] ABSTRACT

Containers such as laboratory glassware are stabilized in their upright resting position by means of a split torus; e.g., a high density rod, preferably of essentially circular cross-section, bent into a substantially, but incompletely closed loop.

12 Claims, 7 Drawing Figures

STABILIZING MEANS FOR LABORATORY WARE

This invention pertains to stabilizing easy to tip equipment particularly equipment found in chemical laboratories. Laboratory ware, such as flasks, graduated cylinders and the like often have an inherent instability in their upright resting position. Thus, they are frequently knocked over accidentally and either spill their contents, break, or both. It is an object of this invention to provide means for stabilizing such laboratory ware so that they will strongly resist such accidental knock downs.

Another problem associated with the laboratory is the placing of flasks in heating and cooling baths, particularly water baths. Because of the buoyancy of the water, it has heretofore been necessary to construct a framework and use a clamping device around the neck of the flask, which device is fastened to the framework. While this is a satisfactory procedure it is cumbersome, takes up space, and requires an inventory of clamps and rods, ring stands, and the like. It is an object of this invention to provide means which will effectively, economically, and easily weigh down the flask in the water bath without attendant clamping devices.

In accord with the invention, there is now provided stabilizing means for laboratory ware, which comprises, in combination, a container and stabilizing means surrounding the container consisting of a weight in the shape of a split torus. The invention also provides as a novel article of manufacture a heavy split torus with a surface of a soft or cushioning material.

Figure 1:
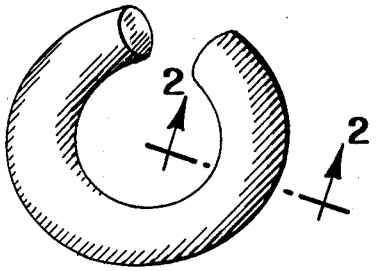
FIG. 1 is a perspective view of the device of the invention.

FIG. 1 illustrates one form of the stabilizing means of the invention. It will be noted that the device is shaped so as to leave a space between the ends of the essentially circular construction. Thus the stabilizing device of the invention is a torus having a small section removed; e.g., a cut or split torus.

Figure 2:
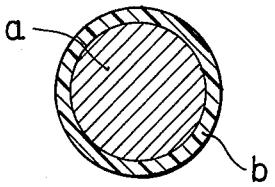
FIG. 2 is a cross-sectional view on line 2—2 of FIG. 1.

FIG. 2 is a cross-sectional view of the split torus of FIG. 1 taken on line 2—2. As will be seen from FIG. 2, the center of the device (a) is a dense solid such as lead and has a coating of a cushioning material (b).

It is to be understood that the term "split torus" which will be used herein is intended to include all appropriate shapes consistent with known topological implications. Thus, although the devices of the invention may be considered to be a rod of circular cross section bent to form an essentially circular torus, a rod of triangular, square or elliptical cross section will also yield devices useful in the invention. Further, the shape of the split torus may be other than essentially circular, for example it may be multi-sided; e.g., square, triangular, rectangular, and the like. Another alternative and useful shape for the split torus is that of a truncated conical section.

The device will be made of a dense material of from about 3 to 20 g/cc and the split torus will be preferably somewhat flexible in that it may be bent by hand. Preferably the device will be made of lead (d. 11.4 but other heavy metals may be used. Thus, for example, copper (d. 8.9) is a useful metal. It will be understood that other heavy non-metal materials may be used such as a high density elastomer or plastic material which, if desired, may be filled to increase its density. For example, a polymeric material such as polyvinyl chloride may be filled with lead shot and formed into the shape of a split torus. Such a device will have an inherent cushion surface and need not be coated. Alternatively, a hollow plastic (e.g. polystyrene or polyvinyl chloride) split torus may be filled with lead shot.

The stabilizing device used in the invention may be manufactured by bending a rod of the appropriate metal to the desired form, but it will be understood, of course, that the split torus may also be obtained by casting or molding in accord with the various known methods. Alternatively, as indicated above, the split torus may first be made in hollow form and filled with heavy material, e.g., lead shot.

It will be understood that the split torus device may be used in any size that is consistent with the particular laboratory ware with which it will be used. A small device will be used for small apparatus and larger ones used for the larger equipment. However, the cross section diameter of the split torus (e.g., that section taken on line 2—2 of FIG. 1) will be preferably from about 0.3 to 1.0 inches and with such a sized cross section there is a preferred relationship of the outside diameter (OD) to inside diameter (ID) of the torus. This OD to ID ratio will be from about 1.25 to about 3.0 By use of a split torus having a relationship within this range, a proper weight and size is maintained which is quite suitable for a wide range of laboratory equipment.

The cushioning material used to coat the device may be selected from a wide variety of materials. Examples are cork, cord, or heavy string wound around the device and the like. Preferably, a polymeric material such as polyvinyl chloride will be used, but it will be understood that other suitable plastic materials are also useful. Thus, polyurethane materials, polyvinyl acetate, polytetrafluoroethylene, and other vinyl polymers and copolymers will have utility as coatings. Such polymeric coatings are applied by any one of the numerous methods known as, for example, by dipping, spray coating, or by immersing the heated object in a fluidized bed of the coating material. As indicated, all of these techniques are well known in the art.

Figure 3:
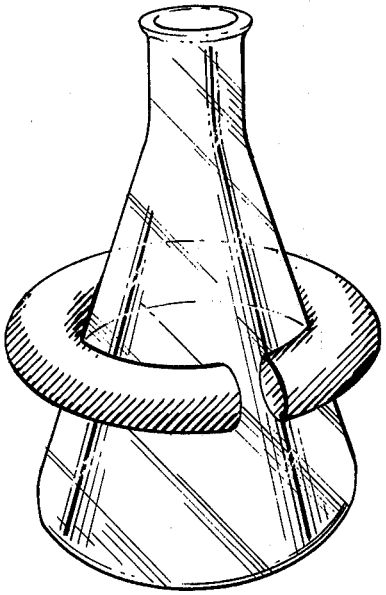
FIGS. 3–7 illustrate how the device of the invention is used.
Figure 4:
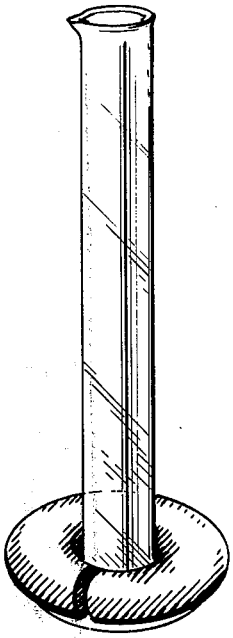
Figure 5:
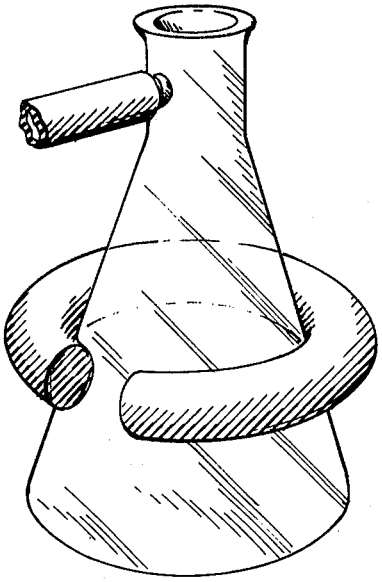

As indicated, the invention will be used with glass or plastic flasks and with other types of equipment. When slipped over an Erlenmeyer flask (see FIG. 3) the device will contact the flask as shown, and thereby impart a high degree of stability to the flask. When slipped over a graduated cylinder (see FIG. 4) the split torus rests at the base of the cylinder and imparts stability to it. FIG. 5 shows how the opening in the split torus of the invention is extremely useful for flasks having a side arm or connections and makes very simple the placement of the device over the side arm. The flexibility of the metal used to make the ring is significant in this particular application since the size of the opening can be enlarged if necessary to pass a thick protrusion through it simply by bending open the slit torus to accommodate the flask and its side arm. Thus a single device can be used with several sized flasks and the opening adjusted as necessary to pass the side arm through it. This, of course, is not possible with a torus which is not split.

Figure 6:
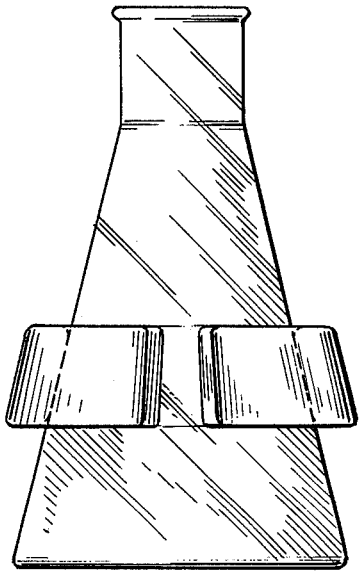

Attention is called to FIG. 6 where an alternative form of split torus device shaped as a truncated conical section is shown on an Erlenmeyer flask. It will be understood that a split torus of other shapes are also included in the invention.

Figure 7:
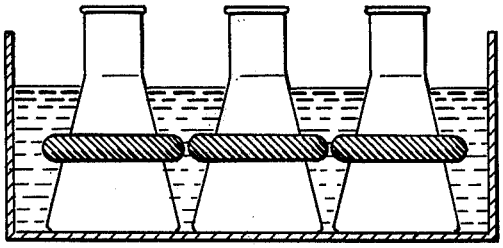

Reference is now made to FIG. 7 where it is seen that several Erlenmeyer flasks are positioned in a water-bath with a split torus placed upon each. The flasks are sufficiently weighted down to be completely stable and do not require any additional neck clamps or other support.

As indicated above only a few sizes are needed to fit the wide range of equipment used in the laboratory. The table which follows indicates the approximate sized devices which are useful for various types of flasks and cylinders.

| Flask Type | | | Split Torus* | | | | |
|---|---|---|---|---|---|---|---|
| Erlen-meyer (ml) | Volu-metric (ml) | Gradu-ated Cylinder (ml) | Weight (gms) | Cross Sec-tion Diam. (in) | In-side Diam. (in) | Out-side Diam. (in) | Ratio OD/ID |
| 25–50 | 25–100 | 10–25 | 210 | 0.56 | 1.38 | 2.50 | 1.81 |
| 50–250 | 100–500 | 25–100 | 650 | 0.75 | 2.00 | 3.50 | 1.75 |
| 200–500 | 1000–2000 | 250–500 | 900 | 0.85 | 2.75 | 4.50 | 1.64 |
| 750–1500 | — | 1000–2000 | 1200 | 0.85 | 4.00 | 5.75 | 1.44 |
| 2000–4000 | — | — | 1750 | 0.90 | 5.63 | 7.50 | 1.33 |

*Made of lead and covered with a coating of polyvinyl chloride of from about 1/16" to about 1/8".

It will, of course, be understood that numerous changes and variations may be mde from the above description without departing from the spirit and scope of the invention.

I claim:

1. A stabilized container having a base area enlarged with respect to a portion of the container above the base area comprising in combination, said container and in cooperative relationship a heavy metal split torus surrounding and resting on said container at the base area of said container to stabilize said container in its upright resting position.

2. A container of the laboratory type having a base area enlarged with respect to a portion of the container above the base area combined and in cooperative relationship with a heavy metal split torus surrounding and resting on said container at the base area of said container to stabilize said container in its upright position.

3. The container and split torus combination of claim 2 where the split torus is made of lead.

4. The container and split torus combination of claim 3 where the surface of the split torus is a soft material.

5. The combination of claim 4 where the soft material is polymeric.

6. The container and split torus of claim 5 where the polymeric material is polyvinyl chloride.

7. The container and split torus combination of claim 2 where the split torus is essentially circular.

8. The container and split torus combination of claim 2 where the split torus is multi-sided.

9. The container and split torus combination of claim 8 where the split torus is four-sided.

10. The container and split torus of claim 8 where the split torus is essentially triangular.

11. The container and split torus of claim 2 where the split torus is a truncated conical section.

12. The stabilized container of claim 1 where the split torus is essentially circular with a cross section of from about 0.3 to about 1 inch and where the ratio of outside diameter to inside diameter of said split torus is from about 1.25 to about 3.0.

* * * * *